United States Patent [19]

Jeschke

[11] Patent Number: 4,588,184

[45] Date of Patent: May 13, 1986

[54] METHOD OF FLOW-FEEDING SHEETS

[75] Inventor: Willi Jeschke, Heidelberg, Fed. Rep. of Germany

[73] Assignee: Heidelberger Druckmaschinen AG, Heidelberg, Fed. Rep. of Germany

[21] Appl. No.: 593,608

[22] Filed: Mar. 26, 1984

[30] Foreign Application Priority Data

Mar. 26, 1983 [DE] Fed. Rep. of Germany ..... 3311196

[51] Int. Cl.[4] ..... B65H 9/00

[52] U.S. Cl. ..... 271/237; 271/250; 271/252; 271/277

[58] Field of Search ..... 271/237, 236, 238, 227, 271/228, 241, 249, 250, 252, 277

[56] References Cited

U.S. PATENT DOCUMENTS

| | | | |
|---|---|---|---|
| 2,245,396 | 6/1941 | Harrold et al. | 271/46 |
| 3,743,277 | 7/1973 | Bolza-Schunemann et al. | 271/237 |
| 3,942,787 | 3/1976 | Bolza-Schunemann | 271/237 |
| 4,350,327 | 9/1982 | Muller | 271/243 |

*Primary Examiner*—Bruce H. Stoner, Jr.
*Assistant Examiner*—John A. Carroll
*Attorney, Agent, or Firm*—Herbert L. Lerner; Laurence A. Greenberg

[57] ABSTRACT

Assembly for stream feeding sheets overlappingly staggered relative to one another via a feed table to an aligning device and for delivering the sheets aligned by the aligning device to a sheet-processing machine, the assembly maintaining movement of the sheets in direction towards the sheet-processing machine during alignment of the sheets by the aligning device, includes an aligning cylinder disposed under the feed table for receiving a sheet to be aligned which is fed thereto via the feed table, at least two rows of front lays disposed symmetrically on and around the circumference of the aligning cylinder, as well as a respective device disposed adjacent the rows of front lays for aligning side edges of the sheet, and a gripping device for holding the sheet until other further-transferring conveying device take over the sheet in-register.

10 Claims, 6 Drawing Figures

METHOD OF FLOW-FEEDING SHEETS

The invention relates to a method and a device for flow-feeding sheets delivered in a continuous stream to an aligning device via a feed table and, after aligning, transmitted to a sheet-processing press, the sheets, during the aligning operation, maintaining their motion in a direction towards the sheet-processing press.

German Published Prosecuted Application (De-AS) No. 1 210 900 discloses a device for flow-feeding sheets. More specifically, the disclosed device is a sheet feeder for printing presses and sheet-processing machines with individually controllable sheet-conveying means which engage the sheet on either side of the center of the sheet. Control of the sheet-conveying means is effected by light barriers, at least two of which are disposed one after the other in the conveying direction. Control pulses from these sensing elements formed as light barriers vary the conveying speed of the corresponding sheet-conveying means through a differentiator circuit so that the leading edge of the sheet approaches the transfer point parallel to the gripper system and at synchronous speed and is transferred to the printing press without previously coming to rest. The sheet is aligned laterally by a diagonal drive with the aid of lateral control lays during the continued movement of the sheet to the transfer point of the press.

The sheets which have been brought in a continuous stream from the pile onto the table are to be separated from one another thereat by an increase in speed so that they pass the table in single file. For this purpose, first of all, a relatively long feed table is necessary. Due to the combination of the forward and side movement of the sheet as well as the sliding of the side edge of the sheet on the side lay, exact alignment of the sheet at the time of transfer is not assured. Experience shows that the sheet, if when left to itself, reacts unpredictably, if for no other reason that that the sheets differ very greatly with regard to the surface quality and side edge formation thereof as well as with regard to the weight and stiffness thereof.

It is accordingly an object of the invention to provide an assembly and method for stream feeding sheets which affords reliable leading and side-edge alignment of the sheets with extremely gentle handling of the sheet edges and which is suitable for all paper grades which are to be processed.

With the foregoing and other objects in view, there is provided in accordance with the invention, an assembly for stream feeding sheets overlappingly staggered relative to one another via a feed table to an aligning device and for delivering the sheets aligned by the aligning device to a sheet-processing machine. The assembly maintains movement of the sheets in direction towards the sheet-processing machine during alignment of the sheets by the aligning device, and comprises an aligning cylinder disposed under the feed table for receiving a sheet to be aligned which is fed thereto via the feed table, at least two rows of front lays disposed symmetrically on and around the circumference of the aligning cylinder, as well as respective means disposed adjacent the rows of front lays for aligning side edges of the sheet, and gripping means for holding the sheet until other further-transferring conveying means take over the sheet in-register.

In accordance with a further feature of the invention, there is provided a pregripper cylinder, and the aligning cylinder is disposed between the feed table and the pregripper cylinder.

In accordance with an additional feature of the invention, the side-edge aligning means comprise respective positionable suction-pull bars disposed upstream of said rows of front lays as viewed in direction of sheet travel.

In accordance with an added feature of the invention, there is provided a positioning means comprising sensors disposed axially adjustably above the aligning cylinder.

In accordance with yet another feature of the invention, there are provided respective front-lay cover grippers operatively associated with each of the rows of front lays, the cover grippers being swingable away into the aligning cylinder, the cover grippers having means for guiding the leading edge of the sheet in the region of the front lays and for gripping the leading edge of the sheet.

In accordance with yet a further feature of the invention, there is provided an assembly for stream feeding sheets overlappingly staggered relative to one another via a feed table to an aligning device and for delivering the sheets aligned by the aligning device to a sheet-processing machine, the assembly continuously maintaining movement of the sheets in direction towards the sheet-processing machine during alignment of the sheets by the aligning device, comprising an aligning cylinder disposed under the feed table for receiving a sheet to be aligned which is fed thereto via the feed table, at least two rows of front lays disposed symmetrically on and around the circumference of the aligning cylinder, respective suction-pull bars likewise disposed on the aligning cylinder upstream of the rows of front lays as viewed in sheet travel direction, and drive means for the suction-pull bars disposed at one side on a side wall of the machine.

In accordance with yet an additional feature of the invention, there is provided means for controlling suction air supplied to the suction-pull bars, the control means being located on the opposite side wall of the machine.

In accordance with yet an added feature of the invention, the aligning cylinder is mounted on a rotating shaft and the suction-air control means comprise a valve ring mounted on the opposite side wall, and a valve body carried by the shaft of the aligning cylinder and rotatable therewith.

In accordance with an alternate feature of the invention, the suction air control means are formed with a suction opening and a fresh-air opening disposed at substantially the same radial distance from the center of a control surface of the valve ring, the valve body also having a control surface formed with a respective air-control opening for each of the suction-pull bars, the air control openings being uniformly distributed at substantially the same radial distance as that of the suction opening and fresh-air opening from the center of the control surface of the valve body, the suction opening and the fresh-air opening being spaced from one another a distance substantially equal to the width of the air control opening.

In accordance with still another feature of the invention, the drive means for the suction-pull bars comprise a stepping motor mounted on the outside of the machine side wall, the stepping motor being coupled free of play with a drive rod via a cam drive, drive rod being axially displaceable in two spherical bushings and having a control segment at an end thereof located to the inside of the side wall, the control segment being positively connected via a pair of drive rollers with respective suction-pull bars of the aligning cylinder.

In accordance with still a further feature of the invention, the control segment is displaceably mounted in a recess formed in a return disc which is fastened to the inner surface of the side wall of the machine.

In accordance with still an additional feature of the invention, the control segment is secured against turning by a stationary guide through the intermediary of a guide roller.

In accordance with still an added feature of the invention, the cam drive comprises a pair of drive cams mounted on a stub of the stepping motor, and the drive rod has a respective cam roller of the cam drives on each of two bearing blocks, the cam rollers being in cooperative engagement with a corresponding one of the drive cams, both of the drive cams being disposed relative to the axis of rotation of the stepping motor so that the spacing between respective paths of the drive cams is constant in each diagonal direction.

In accordance with still another feature of the invention, there is provided an assembly for stream feeding sheets overlappingly staggered relative to one another via a feed table to an aligning device and for delivering the sheets aligned by the aligning device to a sheet-processing machine, the assembly continuously maintaining movement of the sheets in direction towards the sheet-processing machine during alignment of the sheets by the aligning device, comprising an aligning cylinder disposed under the feed table for receiving a sheet to be aligned which is fed thereto via the feed table, at least two rows of front lays disposed symmetrically on and around the circumference of the aligning cylinder, respective suction-pull bars likewise disposed on the aligning cylinder upstream of rows of front lays as viewed in sheet travel direction, and means for driving the suction-pull bars, the driving means being convertible selectively for left-hand and right-hand alignment of a sheet.

In accordance with still a further feature of the invention, the aligning cylinder has means for pregripping the sheet and has means for aligning both a leading and a side edge of the sheet, and includes means for cyclically driving the aligning cylinder non-uniformly.

In accordance with a concomitant feature of the invention, there is provided a method of stream feeding sheets overlappingly staggered relative to one another via a feed table to an aligning device and of delivering the sheets aligned by the aligning device to a sheet-processing machine while maintaining movement of the sheets in direction towards the sheet-processing machine during alignment of the sheets by the aligning device, which comprises first aligning a leading edge of a sheet by a machine part having front lays moved in synchronism with the sheet-processing machine, then aligning a side edge of the sheet and respectively holding and transporting the aligned sheet in a desired position thereof by the aligning device until transfer of the aligned sheet in-register to a further-conveying transporting member is assured.

The forcible leading edge alignment and the firm holding of the sheet by gripping means during the side alignment thereof until transfer to further conveying elements ensures the alignment of the sheet in-register without error or damage. The suitable arrangement of leading edge and side edge aligning means ensures that the overlap between the sheets in the continuous stream is extremely small. The specific feeding and guiding of the sheets during aligning avoids aligning errors even though the sheets do not come to rest during the operation.

The housing of several aligning units in the aligning cylinder permits the machine speed to be increased. The aligning time is extended. A positioning device for the suction-pull bar can also provide for register corrections.

Other features which are considered as characteristic for the invention are set forth in the appended claims.

Although the invention is illustrated and described herein as embodied in method of flow-feeding sheets, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
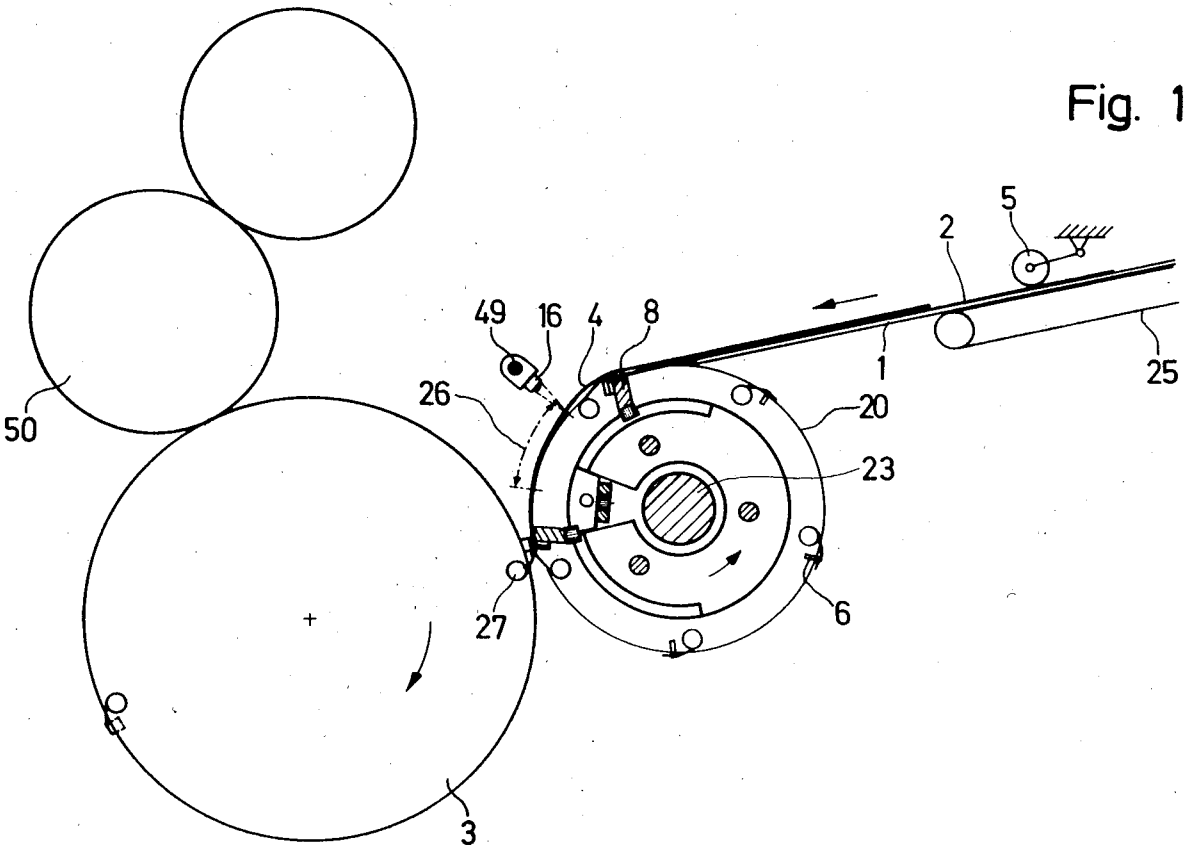
FIG. 1 is a diagrammatic elevational view, partly in section, of a feed table with an aligning cylinder according to the invention.

Referring now to the drawing and first, particularly to FIG. 1 thereof, there are shown sheets 2 being conveyed over a feed table 1 in a continuous stream by conveying elements, symbolized by a roller 5 and a conveyor belt 25, in direction of a sheet-processing machine. A foremost sheet 4 in the stream is gripped by an aligning cylinder 20 which is held in printing machine side walls 21 and 22 under the bottom end of the feed table 1. As can be seen from FIG. 3, the shaft 23 of the aligning cylinder 20 is supported in rolling bearings 24.

The aligning cylinder 20 is followed by a half-revolution pregripper cylinder 3 which may be driven with cyclical irregularity and which transfers the accepted sheet to the impression cylinder 50 of the first printing unit of the sheet-processing machine. The foremost sheet 4 in the overlapping stream is laid with its leading edge against a row of front lays 6 of the aligning cylinder 20 and is aligned. After being aligned, the sheet 4 is engaged by a suction pull bar 8 in such a manner that static friction occurs. Due to this firm suction, the sheet 4 is conveyed into the aligning region 26 by the aligning cylinder 20 which rotates counter-clockwise. Following the side alignment which is described in greater detail hereinafter, the aligning cylinder 20 transfers the aligned sheet to a gripper bridge 27 of the pregripper cylinder 3.

In the illustrated embodiment of the invention, the aligning cylinder 20 is provided with five rows of front lays 6 which are disposed symmetrically over the circumference. A suction-pull bar 8 is directly associated with each of these rows of front lays 6. The particular construction of the aligning cylinder 20 is seen in detail in FIGS. 2 and 3. Sheet-guiding segments 28 are provided in the outer cylindrical surface of the aligning cylinder 20 between two neighboring groups of aligning elements. These segments 28 are mounted on a cross-member or transverse rod 29, adjustable in axial direction of the aligning cylinder 20 so that, between respective pairs thereof, a scanning gap 15 for a positioning device may be formed. The linear extension of the sheet-guiding segments 28 in circumferential length of the aligning region 26.

Mounted in the side walls 21 and 22 above the aligning cylinder 20 between the feed table 1 and the pregripper cylinder 3 is a cross-member 49 which extends transversely over the machine and on which one or two sensors 16 of an otherwise non-illustrated positioning device are displaceably disposed. These sensors 16 serve to trigger a signal when the side edge of the sheet 4 passes the positioning device in order to obtain corresponding control of the suction-pull bar 8. The sensors 16 are set to the respective sheet format to be used. In accordance with the set position of one of the sensors 16, the sheet-guide segments 28 provided in this region are also disposed relative to one another in such a manner that there is a scanning gap 15 directly under the sensor 16.

From the aligning cylinder 20, the aligned sheet 4 is passed on to the gripper bridge 27 of the pregripper cylinder 3. In a conventional manner, the two gripper bridges 27 in the pregripper cylinder 3 are pivotable so that, following the transfer of the sheet, they gradually swing back from a swung-out position onto the circumference of the pregripper cylinder 3, as a result of which the gripped sheet 4 is gradually accelerated from the relatively low peripheral speed of the aligning cylinder 20 to the higher peripheral speed of the pregripper cylinder 3.

Forward or front-lay cover grippers 30 which are controlled by a swivel or pivot shaft 31 mounted in the aligning cylinder 20 are tiltably held by two supports or straps 36 of a gripper shaft 32. Mounted on the gripper shaft 32 is a roller lever 33 having a free end provided with a guide roller 34 which rides on and cooperates with a control cam 35 rotating with the aligning cylinder 20. The aforementioned straps 36 are firmly or rigidly mounted on the swivel shaft 31 which extends coaxially in the aligning cylinder 20. Due to swivelling of the straps or supports 36 by the control shaft 31, the front-lay cover grippers 30 are lifted off the sheet 4 and, directly thereafter, this row of grippers 30 is pulled into the inside of the circumference of the aligning cylinder 20. When the straps or supports 36 are swivelled in the opposite direction, the front-lay cover grippers 30 are initially swung out of the retracted position thereof over the circumference of the aligning cylinder and are then tilted or tripped into the sheet-guiding position thereof. A sheet-guiding surface 37 is provided in the circumference of the aligning cylinder 20 over a given region in front of each row of front or forward lays 6.

Figure 2:
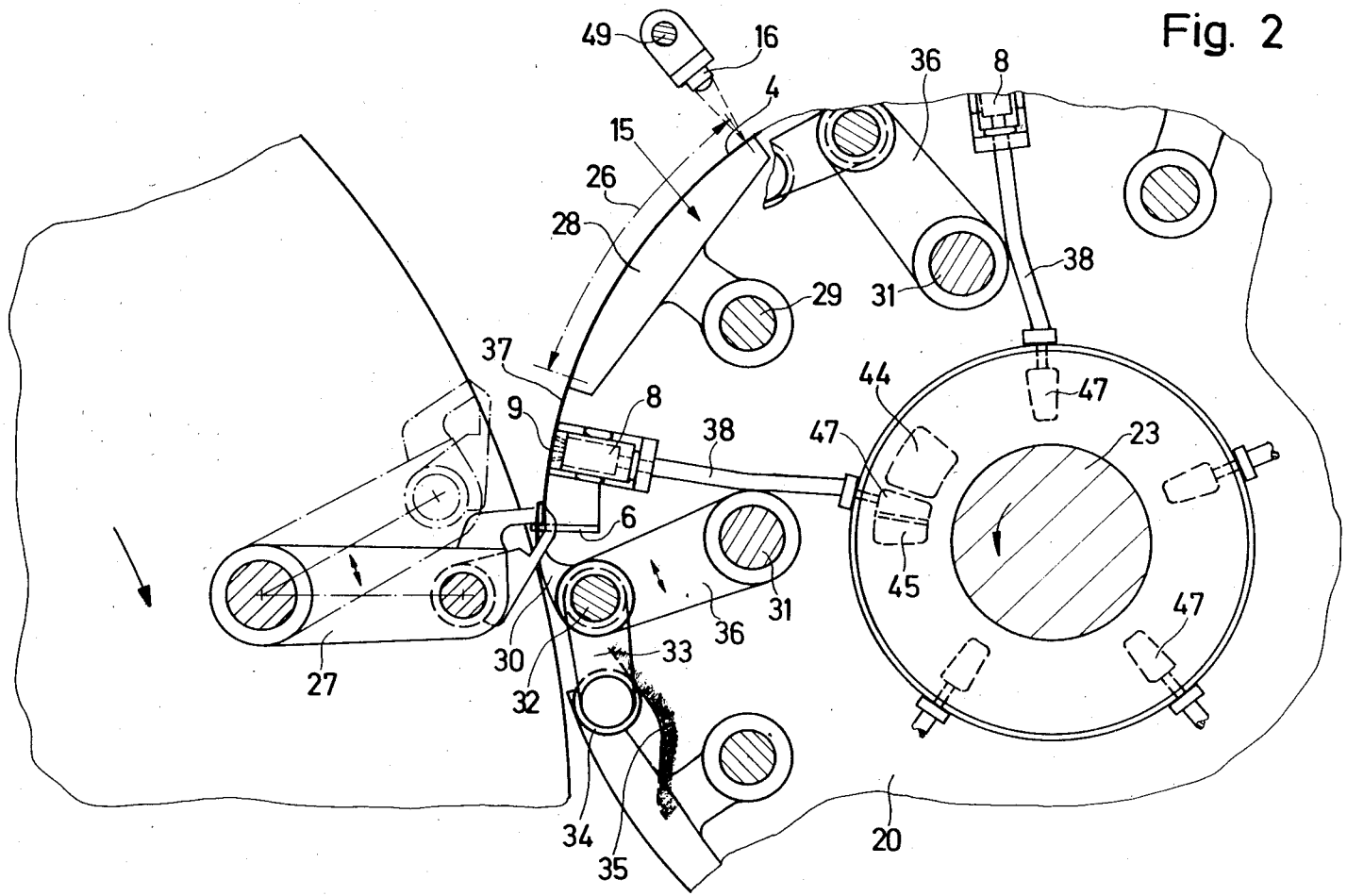
FIG. 2 is an enlarged fragmentary view of FIG. 1 showing the aligning cylinder in the aligning region.
Figure 3:
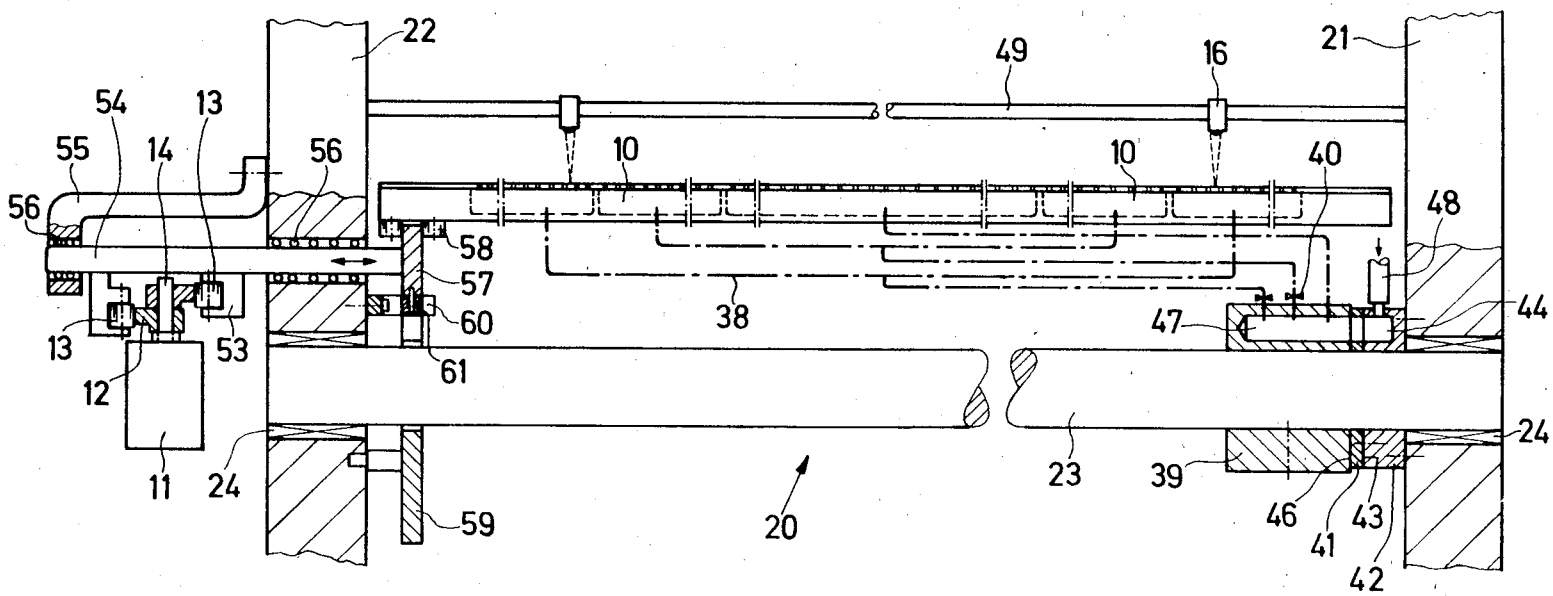
FIG. 3 is a diagrammatic, partly schematic and partly sectional view of the sheet feeder at the level of the aligning cylinder, as viewed from the sheet-processing machine i.e. from the left-hand side of FIG. 1.

As is apparent from FIG. 3, the suction-pull bar 8 is formed basically of a row of separate suction chambers 10. The latter are connected by air lines 38 to a valve body 39 in such a way that the two outer suction chamber groups can be switched on or off by valves 40 depending upon the size of the sheet format being processed. The valve body 39 is rigidly mounted on the shaft 23 of the aligning cylinder 20. By means of a seal 41, the valve body 39 cooperates with a valve ring 42 which is mounted on the side wall 21 of the sheet-processing machine. As viewed from the axis of rotation of the aligning cylinder 20, a suction opening 44 as well as a fresh-air opening 45 are provided in the control face 43 of the valve ring 42 at the same radial elevation. Conversely, the control face 46 of the valve body 39 is formed with control opening 47 for each section-pull bar 8. All of the air lines 38 of the suction chambers 10 of the corresponding suction-pull bars 8 are connected to the air control opening 47. As is shown in FIG. 2, the air control openings 47 are located at the same radial height as suction and fresh-air openings 44 and 45. The width of the air control openings 47 corresponds roughly to the distance between the suction opening 44 and the fresh air opening 45. To generate a vacuum, the suction opening 44 of the valve ring 42 is connected via an air line 48 to an otherwise non-illustrated vacuum generator. The dimensions of the suction opening 44, the fresh air opening 45 and the air control opening 47 are such that the vacuum generated in whichever suction-pull bar 8 is operating is sufficient to hold the sheet 4 by means of static friction and, on the other hand, stops immediately when fresh air is fed in the instant the gripper bridge 27 has firmly accepted the leading edge of the sheet in register.

Because, as mentioned hereinabove, FIG. 3 shows a section through the sheet feeder at the level of the aligning drum 20 as viewed from the sheet-processing machine, the drive of the suction-pull bars 8 is on the drive side of the sheet feeder. This drive is formed first of all of a stepping motor 11 with a reduction gear which is fastened to the side wall 22 by non-illustrated conventional means. Mounted on a shaft stub 14 of the stepping motor 11 are two identical drive cams 12 which are diametrically opposed in a manner that, in a direction diagonal to the rotational axis of the stepping motor 11, the two cam paths are always at the same distance from one another. A respective cam roller 13 runs on each of these drive cams 12. Both cam rollers 13 are fastened to a drive rod 54 by means of respective bearing blocks 53 in a manner that the rotational movement of the shaft stub 14 of the stepping motor 11 is transmitted without play to the drive rod 54.

The drive rod 54 is axially displaceably mounted, indeed first in the guide bracket 55 and second in the machine side wall 22. Both mounting bearings are formed of spherical bushes 56. The free end of the drive rod 54 which projects into the inside of the machine is provided with a control segment 57 which can come into engagement with drive rollers 58 of each suction-pull bar 8 and, in fact, in such a manner that the axial drive movement of the drive rod 54 is transmitted without play to the respective suction-pull bar 8.

The control segment 57 is housed in a recess of a return disc 59 so that it is displaceable in the axial direction of the drive rod 54. A guide 60 projects into this recess in the return disc 59, and a guide roller 61 runs therein. The guide roller 61 is rotatably attached to the underside of the control segment 57. The guide 60 and the guide roller 61 together prevent the drive rod 54 from turning. Both the guide 60 as well as the return disc 59 are attached to the machine side wall 22.

Figure 6:
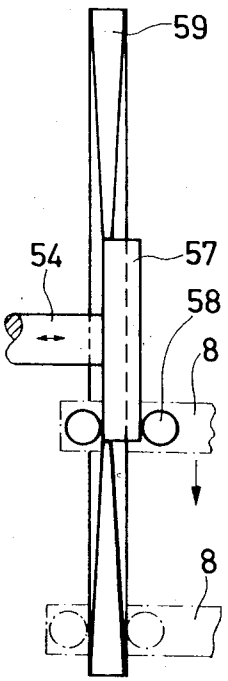
FIGS. 4 to 6 are enlarged fragmentary views of FIG. 3 as seen from the bottom thereof showing details of the drive of the suction-pull bar.
Figure 5:
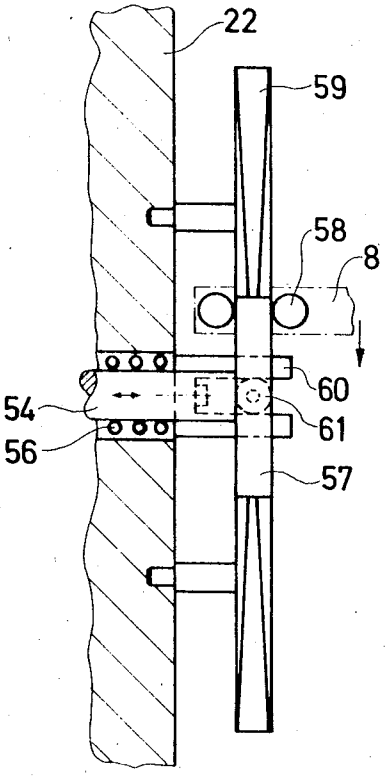
Figure 4:
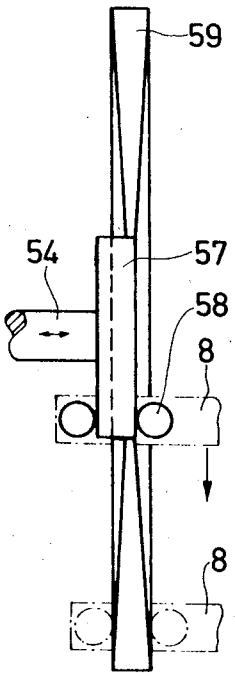

FIGS. 4 to 6 show the important working positions of the control segment 57. In FIG. 5, the control segment 57 is in a middle zero position thereof. The control segment 57 assumes this position before a suction-pull bar 8 is to be adjusted or set. As is apparent from FIG. 5, the guide rollers 58 of a respective suction-pull bar 8, which are normally guided by the return disc 59, have just reached the control segment 57, the suction-pull bar 8, as aforementioned, rotating with the aligning cylinder 20. At this instant, the adjustment or setting operation on the suction-pull bar 8 can begin. If the sensor 16 of the positioning device is in action on the operator side of the machine, the stepping motor 11 turns the drive cams 12 via the shaft stubs 14 thereof so that the drive rod 54 is drawn via the cam roller 13 towards the drive side of the sheet-processing machine. After traversing a maximum stroke, the suction-pull bar 8 stops. This position is shown in FIG. 4. If, conversely, the stepping motor 11 is controlled by the positioning device, which is normally the case, the control segment 57 stops in any desired position before reaching the maximum stroke. In this regard, the adjusted suction-pull bar 8 traverses the respectively required aligning stroke. When the aligning operation is completed, the aligned sheet 4 is accepted or taken over by further conveying means. After this adjustment operation, the return disc 59 returns the suction-pull bar 8 into the zero position.

If, on the other hand, the sensor 16 is in operation on the drive side, the stepping motor 11 is also switched accordingly. During the aligning operation, it moves the drive rod 54 into the interior of the machine, at most into the position shown in FIG. 6. With appropriate positioning, the control segment 57 naturally also comes to a stop before this end position is reached because the suction-pull bar 8 has reached the desired position of the sheet to be aligned. In this position, the suction-pull bar 8 holds the aligned sheet until it has been accepted by the pregripper cylinder 3. Following transfer of the sheet, the adjusted suction-pull bar 8 is again returned to the zero position thereof by the return disc 59.

The operation of the hereinaforedescribed embodiment of the invention is as follows:

The conveying means 5 and 25 of the feed table 1 convey the sheets 2 in an overlapping stream slightly faster than the peripheral speed of the aligning cylinder 20. Owing to this difference in speed, the front or foremost sheet 4 in the stream is laid reliably against the row of front lays 6 which are moving in the waiting position. To ensure the reliability of this laying, the front-lay cover grippers 30 are located in such a position that the front or leading edge of the sheet 4 cannot shift away, but is forcibly guided against the front lays 6. Owing to the propulsion or forward thrust of the continuous overlapping stream of the sheets 2 and owing to the conveying device 5, 25 of the feed table 1, the front or leading edge of the sheet 2 is properly aligned before the aligning region 26 is reached.

After this alignment of the front or leading edge of the sheet, which occurs during continuous rotation of the aligning cylinder 20, alignment of the side edge of the sheet begins in the aligning region 26. This side edge alignment is started by having the front or leading region of the sheet 4 firmly sucked against the suction surface 9 of the suction-pull bar 8. The suction force is such that static friction is produced between the underside of the sheet and the suction surface 9. After the front or leading edge alignment, the sheet 4 is therefore gripped so that is cannot slip.

After the sheet 4 has been gripped by the suction-pull bar 8, the latter has reached the position thereof shown in FIG. 5. The drive rollers 58 thereof are thus in zero-clearance or play-free contact with the control segment 57. Via the stepping motor 11, the cam drive 12, 13 and the drive rod 54, the control segment 57 is then moved in a direction towards the end or final position thereof according to FIG. 4. The sheet 4 is, thus, drawn towards the drive side. The edge of the transported sheet 4 on the operators side passes the measuring beam of the sensor 16 in the aligning region 26 so that, owing to the fact that the scanning gap 15 is free, the sensor no longer detects any reflected light. Absence of light causes the sensor to generate a pulse which, in turn, causes the positioning device to control the stepping motor 11 so that, beginning with this instant, the sheet 4 traverses a specific distance only, for example two millimeters. It has then reached its desired lateral or side position.

This entire side alignment operation occurs in a time period wherein the operated suction-pull bar 8 passes the aligning region 26. After the resulting alignment, the suction-pull bar 8 holds the sheet in the desired aligned position. As a supporting measure, the front-lay cover grippers may also hold the sheet in order to provide additional guidance of the aligned sheet 4 until its final transfer to the gripper bridge 27 of the pregripper cylinder 3.

When the gripper bridge 27 has reliably gripped the aligned sheet 4, the air control opening 47 of the valve body 39 of that suction bar 8 which has just had vacuum applied to it reaches the fresh air opening 45, as a result of which the vacuum suddenly stops due to the supply of fresh air. The static friction between the suction surface 9 of the suction-pull bar 8 and the underside of the sheet 4 is cancelled or terminated. The in-register sheet 4 can now be lifted off the sheet-guiding face 37 by the gripper bridge 27.

Before the gripper bridge 27 moves the sheet 4 from the sheet guide face 37 in the circumferential direction of the feed cylinder 3, however, the straps or supports 36 are swiveled by the control shaft 31. In this connection, the guide roller 34 runs along the control cam 35 and initially causes the front-lay cover grippers 30 to lift off the sheet 4 and then to swing into the aligning cylinder 20. The gripper bride 27 of the feed cylinder 3 can then remove the aligned sheet 4 from the outer cylindrical surface of the aligning cylinder 20. The suction-pull bar 8 which has just been used is returned to the zero position according to FIG. 5 during the further rotation of the aligning cylinder 20. Upon reaching the feed table 1, each suction-pull bar 8 is therefore again ready for operation. Furthermore, in this position, the front-lay cover grippers 30 are swung out so that the front or leading edge of the sheet 4 which is then to be aligned reliably comes to lie against the front lays 6.

The foregoing is a description corresponding, in substance, to German application P No. 33 11 196.0-27, dated Mar. 26, 1983, international priority of which is being claimed for the instant application, and which is hereby made part of this application. Any material discrepancies between the foregoing specification and the specification of the aforementioned corresponding German application are to be resolved in favor of the latter.

There is claimed:

1. Assembly for stream feeding sheets overlappingly staggered relative to one another via a feed table to an aligning device and for delivering the sheets aligned by the aligning device to a sheet-processing machine, the assembly continuously maintaining movement of the sheets in direction towards the sheet-processing machine during alignment of the sheets by the aligning device, comprising an aligning cylinder disposed under the feed table for receiving a sheet to be aligned which is fed thereto via the feed table, at least two rows of front lays disposed symmetrically on and around the circumference of said aligning cylinder, respective suction-pull bars likewise disposed on said aligning cylinder upstream of said rows of front lays as viewed in sheet travel direction, and drive means for said suction-pull bars disposed at one side on a side wall of the machine.

2. Assembly according to claim 1 including means for controlling suction air supplied to said suction-pull bars, said control means being located on the opposite side wall of the machine.

3. Assembly according to claim 2 wherein said aligning cylinder is mounted on a rotating shaft and wherein said suction-air control means comprise a valve ring mounted on said opposite side wall, and a valve body carried by said shaft of said aligning cylinder and rotatable therewith.

4. Assembly according to claim 3 wherein said suction-air control means are formed with a suction opening and a fresh-air opening disposed at substantially the same radial distance from the center of a control surface of said valve ring, said valve body also having a control surface formed with a respective air-control opening for each of said suction-pull bars, the air control openings being uniformly distributed at substantially the same radial distance as that of said suction opening and fresh-air opening from the center of said control surface of said valve body, said suction opening and said fresh-air opening being spaced from one another a distance substantially equal to the width of said air control opening.

5. Assembly according to claim 1 wherein said drive means for said suction-pull bars comprise a stepping motor mounted on the outside of said machine side wall, said stepping motor being coupled free of play with a drive rod via a cam drive, said drive rod being axially displaceable in two spherical bushings and having a control segment at an end thereof located to the inside of said side wall, said control segment being positively connected via a pair of drive rollers with respective suction-pull bars of said aligning cylinder.

6. Assembly according to claim 5, wherein said control segment is displaceably mounted in a recess formed in a return disc which is fastened to the inner surface of said side wall of the machine.

7. Assembly according to claim 5, wherein said control segment is secured against turning by a stationary guide through the intermediary of a guide roller.

8. Assembly according to claim 5 wherein said cam drive comprises a pair of drive cams mounted on a stub of said stepping motor, and wherein said drive rod has a respective cam roller of said cam drives on each of two bearing blocks, said cam rollers being in cooperative engagement with a corresponding one of said drive cams, both of said drive cams being disposed relative to the axis of rotation of said stepping motor so that the spacing between respective paths of said drive cams is constant in each diagonal direction.

9. Assembly according to claim 1 wherein said aligning cylinder has means for pregripping the sheet and has means for aligning both a leading and a side edge of the sheet, and including means for cyclically driving said aligning cylinder non-uniformly.

10. Assembly for stream feeding sheets overlappingly staggered relative to one another via a feed table to an aligning device and for delivering the sheets aligned by the aligning device to a sheet-processing machine, the assembly continuously maintaining movement of the sheets in direction towards the sheet-processing machine during alignment of the sheets by the aligning device, comprising an aligning cylinder disposed under the feed table for receiving a sheet to be aligned which is fed thereto via the feed table, at least two rows of front lays disposed symmetrically on and around the circumference of said aligning cylinder, respective suction-pull bars likewise disposed on said aligning cylinder upstream of said rows of front lays as viewed in sheet travel direction, and means for driving said suction-pull bars, said driving means being convertible selectively for left-hand and right-hand alignment of a sheet.

* * * * *